United States Patent [19]

Hwang

[11] Patent Number: 4,995,619

[45] Date of Patent: Feb. 26, 1991

[54] SHUTTLECOCK

[76] Inventor: Kuo H. Hwang, 2F3R, No. 14, Ching Chung St., Tainan, Taiwan

[21] Appl. No.: 510,032

[22] Filed: Apr. 17, 1990

[51] Int. Cl.[5] ..... A63B 67/18

[52] U.S. Cl. ..... 273/417; 446/397

[58] Field of Search ..... 273/417, 419, 420, 416, 273/344–347; 446/397, 404

[56] References Cited

U.S. PATENT DOCUMENTS

| | | | |
|---|---|---|---|
| 1,424,674 | 8/1922 | Orr | 273/420 |
| 1,918,718 | 7/1933 | Samsel | 273/344 |

FOREIGN PATENT DOCUMENTS

| | | | |
|---|---|---|---|
| 216536 | 7/1958 | Australia | 273/417 |
| 2594039 | 8/1987 | France | 273/417 |

*Primary Examiner*—Paul E. Shapiro

*Attorney, Agent, or Firm*—Alfred Lei

[57] ABSTRACT

A shuttlecock for hitting or kicking by a hand, foot or racket comprising a hollow elastic body, a head connected with the body and a tail connected with the head. The body can shrink to press the air in its hollow interior through a curved through hole in the head to give out a whistling sound when this shuttlecock is hit or kicked.

4 Claims, 2 Drawing Sheets

SHUTTLECOCK

BACKGROUND OF THE INVENTION

Nowadays, industry and commerce have extremely developed so that cities have grown more and more crowded with people, who are forced to have less and less space for living owing to fast rising cost of land and houses. Besides, except weekends they cannot get rather long hours for enjoying leizure, exercise or sports. Therefore, this invention has been devided to furnish an easy means for a kind of exercise which does not need a large space but can be played at any time or place.

SUMMARY OF THE INVENTION

This invention concerns a shuttlecock which can be played by a hand, foot or racket. It comprises a hollow elastic body, a head and a tail.

The hollow elastic body is cylindrical and hollow in its interior, has enough elasticity to shrink to press the air in its interior to flow through and out of a curved through hole provided in the head when this shuttlecock is hit by a hand or racket or kicked by a foot. The hollow elastic body has, as a hitting face, a flat face with a circumferential inclined edge at its bottom.

The head is shaped as a curved cone, extending up from the upper face of the body and having a curved through hole communicating with the hollow interior of the body such that the air in the hollow interior of the body can be pressed to run through and out of the curved through hole to give out a whistling sound when this shuttlecock is hit or kicked.

The tail is made of a plurality of feathers or the equivalent and extending up from the head, giving the shuttlecock a balance during flying.

DETAILED DESCRIPTION OF THE INVENTION

Figure 1:
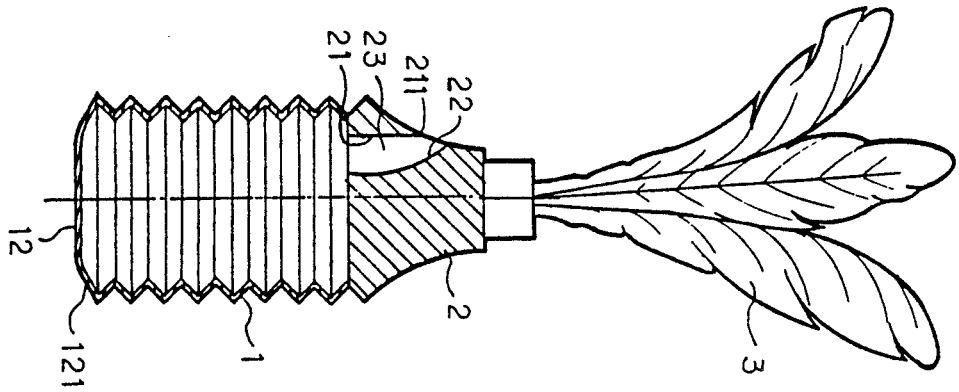
FIG. 1 is a cross-sectional view of the first embodiment of the shuttlecock in accordance with the present invention.

The shuttlecock in the present invention, as FIG. 1 shows, comprises a hollow elastic body 1, a head 2 and a tail 3 as tis main components.

The hollow elastic body 1 is shaped as a cylinder having a corrugated circumferential surface and possible to shrink lengthwise. The hollow elastic body 1 has its closed bottom face used as a hitting face 12, which is flat but has an inclined circumferential edge 121 convenient for being hit or kicked by a hand, foot or racket.

The head 2 extends upward from the upper face of the hollow elastic body 1, shaped as a cone having a curved circumferential surface, and having a through curved hole 23 formed with a flat face 21 and a curved face 22 and extending from a proper place in the circumferential surface to the hollow interior of the hollow elastic body 1. When the elastic body 1 is compressed by hitting or kicking, the air in its hollow interior can be pushed through and out of the through hole 23. As the space of the hollow interior of the body 1 is larger than that of the hole 23, the air pressure and speed can become quite large enough to give out a whistling sound when the air runs out of the opening 211 of the hole 23.

Figure 2:
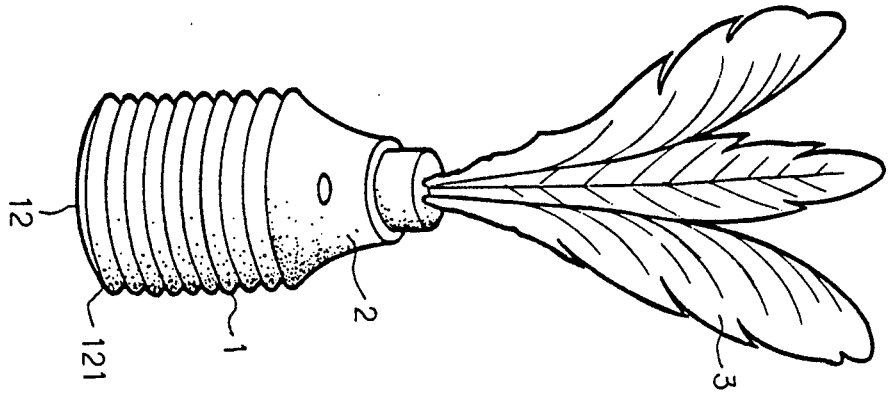
FIG. 2 is a perspective view of the first embodiment of the shuttlecock in accordance with the present invention.
Figure 3:
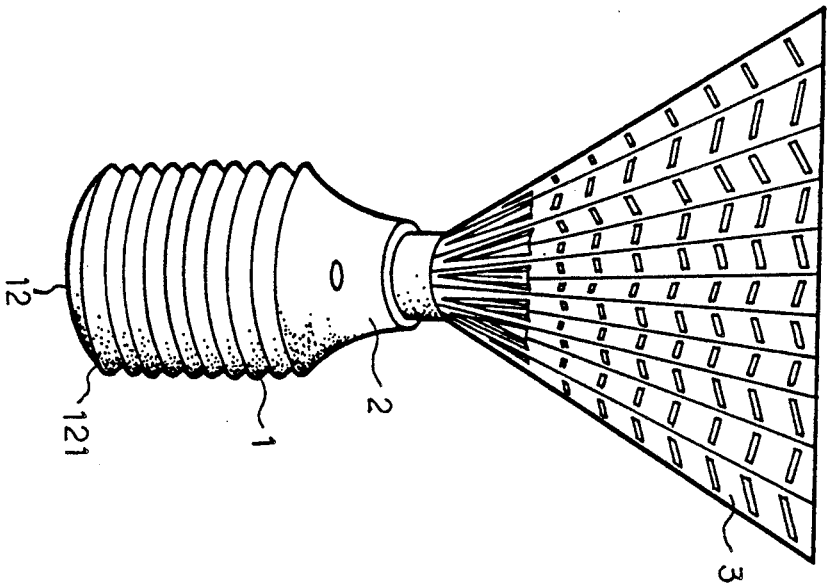
FIG. 3 is a perspecxtive view of the second embodiment of the shuttlecock in accordance with the present invention.
Figure 4:
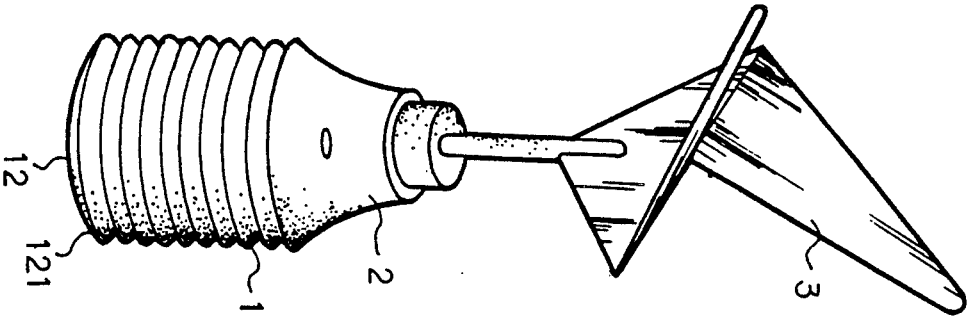
FIG. 4 is a perspective view of the third embodiment of the shuttlecock in accordance with the present invention.

The tail 3 is made of a plurality of feathers as shown in FIG. 2 or the equivalent as shown in FIGS. 3 and 4 to give balance to the shuttlecock during its flying, but it can include many different forms not described here. FIG. 3 shows the second embodiment of the tail 3 having an inlcined net shape so as to make this shuttlecock fly in a straight line when it is hit by hand or racket or kicked by foot. The FIG. 4 shows the third embodiment of the tail 3 having two leaves bended adjacent in an angle and able to turn around rapidly and fall down slowly when kicked up high in the air by foot.

What is claimed is:

1. A shuttlecock comprising a hollow elastic body shaped as a corrugated cylinder having a closed bottom at one end and able to shrink lengthwise, a head shaped as a curved cone extending up from the other end of the hollow elastic body and having a curved through hole made up of a curved hole face and a flat hole face, the curved through hole having an opening in a proper point of the curved face of the head and communicating with the hollow interior of the hollow elastic body, and a tail having a plurality of feathers or the equivalent and extending up from the head.

2. The shuttlecock as claimed in claim 1, wherein the hollow elastic body is provided with a hitting face at the closed bottom.

3. The shuttlecock as claimed in claim 2, wherein the hitting face is flat at the center section and inclined around its circumferential edge.

4. The shuttlecock as claimed in claim 1, 2 or 3, wherein the hollow elastic body can be compressed to shrink lengthwise so that the air in the hollow interior in the hollow elastic body can be pressed to run through the curved through hole in the head as a fast and high-pressured air current, which can give out a whistling sound when it runs out of the opening of the curved through hole.

* * * * *